United States Patent [19]

Zongker

[11] Patent Number: 4,709,618

[45] Date of Patent: Dec. 1, 1987

[54] SERIES SELF-LEVELING VALVE WITH SINGLE SPOOL FOR UNLOADING AND RELIEF

[75] Inventor: Dwight E. Zongker, Plevna, Kans.

[73] Assignee: The Cessna Aircraft Company, Wichita, Kans.

[21] Appl. No.: 783,119

[22] Filed: Oct. 2, 1985

[51] Int. Cl.[4] ..... F15B 11/22; F15B 13/07; B66F 3/46

[52] U.S. Cl. ..... 91/31; 91/513; 91/516; 91/520; 414/708

[58] Field of Search ..... 414/708; 91/31, 516, 91/517, 518, 520, 532, 512, 514, 515, 420; 137/596; 251/282

[56] References Cited

U.S. PATENT DOCUMENTS

| | | | |
|---|---|---|---|
| 2,306,379 | 12/1942 | Conradson | 91/532 X |
| 2,988,891 | 6/1961 | Hemings | 137/596 X |
| 3,023,584 | 3/1962 | Markovich | 91/532 X |
| 3,073,123 | 1/1963 | Hodgson et al. | 91/520 X |
| 3,161,111 | 12/1964 | Williams | 91/517 X |
| 3,179,120 | 4/1965 | Erickson et al. | 414/708 X |
| 3,217,726 | 11/1965 | Rohweder et al. | 91/516 X |
| 3,251,277 | 5/1966 | Stacey | 91/518 X |
| 3,563,137 | 2/1971 | Graber et al. | 91/520 X |
| 3,654,835 | 4/1972 | Sievenpiper | 137/596 X |
| 3,883,023 | 5/1975 | Bernhoft | 91/517 X |
| 3,987,920 | 10/1976 | Parquet et al. | 91/531 |
| 4,058,139 | 11/1977 | Budzich | 137/596 X |
| 4,349,305 | 9/1982 | Wynn et al. | 91/516 X |
| 4,352,398 | 10/1982 | Schantz | 91/518 X |
| 4,408,518 | 10/1983 | Diel et al. | 91/516 X |
| 4,561,342 | 12/1985 | Calvert | 91/31 |
| 4,622,886 | 11/1986 | Imada et al. | 91/520 |

*Primary Examiner*—Robert E. Garrett
*Assistant Examiner*—George Kapsalas
*Attorney, Agent, or Firm*—Edward L. Brown, Jr.

[57] ABSTRACT

A self-leveling series type hydraulic system including boom and bucket valves which separately control boom and bucket cylinders and a flow divider valve positioned in the exhaust flow path of the rod end of the boom cylinder. The flow divider valve splits the flow sending a portion of it to the cap end of the bucket cylinder so as to maintain the bucket in a level condition during raising of the boom with the remaining flow connected to one of the boom valve motor ports. An improved boom lower circuit which bypasses the flow divider valve as the boom is lowered to achieve a faster boom lower rate and the inclusion of an unloading valve in the bucket circuit which includes the dual function of preventing cavitation and relieving high pressure.

1 Claim, 1 Drawing Figure

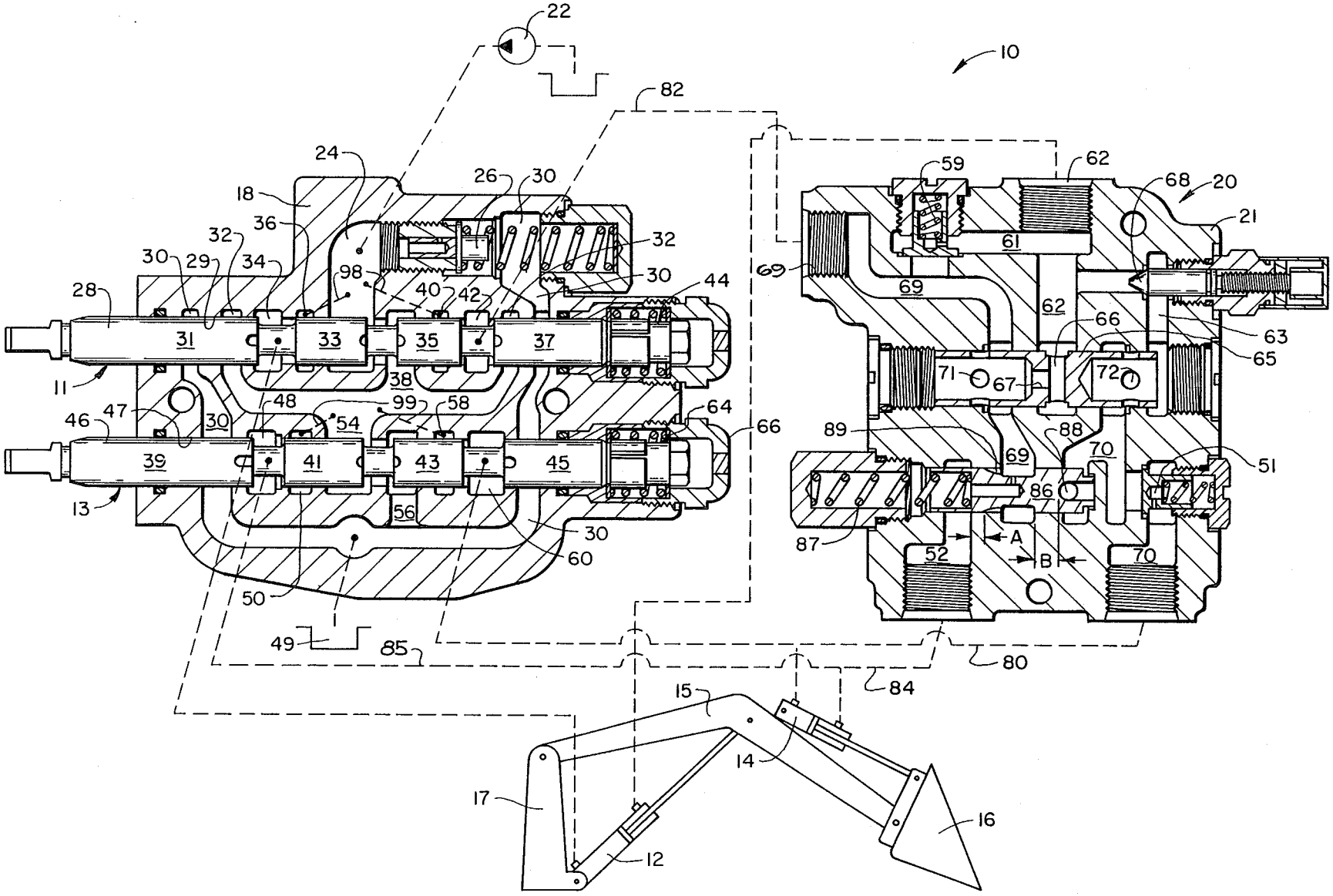

SERIES SELF-LEVELING VALVE WITH SINGLE SPOOL FOR UNLOADING AND RELIEF

BACKGROUND OF THE INVENTION

This invention relates generally to controls for hydraulic power systems and more specifically to directional control valves that selectively effect automatic leveling of a bucket on the front end of a loader or similar device during movement of the boom arm to which the bucket is attached.

It is conventional practice to provide a hydraulic cylinder and separate control valve for manipulating the bucket of a front end loader and a second cylinder and companion valve for raising and lowering the boom of the loader. In the absence of any self-leveling function, it is necessary for the operator of the loader to operate both valves, one with each hand, to maintain the bucket level while raising the boom. This operation is not only difficult but also requires the strict attention of the operator. The advantages of self-leveling systems are obvious and there have been numerous types of systems on the market for many years.

One of the more common methods, such as shown in U.S. Pat. No. 3,987,920 to Parquet, is a mechanical linkage tied to the frame of the loader which tilts the bucket, maintaining it level as the boom is raised or lowered. Another common method, which is strictly hydraulic, is illustrated in U.S. Pat. No. 3,251,277 to Stacey. In this patent, the fluid displaced from the boom cylinder is directed to the bucket cylinder by actuation of the boom spool alone. This type of system requires a matching of volumes so that the volume displaced from the boom cylinder will extend the bucket cylinder the precise distance to hold the bucket level as the boom is raised.

Another self-leveling system is shown in U.S. Pat. No. 3,563,137 to Graber wherein the flow exiting the boom cylinder passes through a flow divider, dumping a portion to drain while directing the remaining portion to the bucket cylinder to maintain a level condition while raising the boom. In the last-mentioned patent, the excess oil is removed from the self-leveling circuit by a proportional flow divider dumping to drain. However, such a system can only be used in a conventional parallel circuit, as distinguished from a series type circuit to which the present invention is directed. In a series type valve, if the upstream valve is moved to an operative position, there is no pump pressure available to the remaining downstream valve since the power passages are in the series. Series type valves are normally not adaptable to a self-leveling function with the exception of the previously mentioned patent to Stacey; applicant's U.S. Pat. Nos. 4,561,342, 4,408,518 and applicant's pending U.S. application Ser. No. 464,071.

In the last-mentioned patent, a flow divider is utilized in the boom discharge flow path with a portion going to the bucket cylinder while the remaining flow passes back to the valve in the boom return motor port. This last-mentioned flow through the boom return port provides downstream oil for the bucket cylinder if the operator attempts to override the self-leveling function while the boom cylinder is moving.

SUMMARY OF THE INVENTION

In the present invention, the unloading valve has an additional function as a relief valve which not only prevents cavitation of the cylinder when the load in the bucket attempts to overrun the pump, but also provide a relieving function when there is excess pressure in the bucket cylinder. The prior art required a separate relief valve in the circuit. The present invention also includes a bypass passage in the boom lower circuit which will allow the pump pressure to bypass the restricted flow path in the flow divider valve so that the boom can be lowered at a much faster rate without the danger of cavitation.

It is therefore the principal object of the present invention to provide a series type self-leveling system that directs only the necessary portion of the boom discharge fluid to actuate the bucket cylinder and maintain a level condition while still allowing the bucket cylinder to override the self-leveling function if desired.

Another object of the present invention is to provide a series type control valve assembly including separate valves for controlling boom and bucket cylinders and a flow divider for directing a portion of the fluid returning from the boom cylinder with an improved boom lower circuit.

Another object of the present invention is to provide a self-leveling system which is simple in design and less expensive than parallel systems.

Another object of the present invention is provide an inexpensive flow divider valve which can be plumbed into an existing conventional open-center series system so as to achieve automatic self-leveling with an unloading valve in the bucket return circuit which also functions as a relief valve in that circuit.

Other objects and advantages of the present invention are described in or will become apparent from the following detailed description and accompanying drawing of the preferred embodiment.

BRIEF DESCRIPTION OF THE DRAWING

The drawing is a partially schematic representation of the hydraulic controls for a front-end loader including longitudinal sectional views of the control valves with the boom and bucket valves in neutral positions.

DESCRIPTION OF THE PREFERRED EMBODIMENT

With reference to the drawing, the system includes boom and bucket cylinders 12 and 14, respectively, which are controlled by boom and bucket directional control valves 11 and 13. Boom 15 which can be of many types, is pivotally mounted to the base frame 17 of the loader while bucket 16 is attached to the end of the boom 15 and bucket cylinder 14.

Positioned between the control valves 11 and 13 and the boom bucket cylinders 12 and 14, respectively, is a self-leveling valve generally described by reference numeral 10, as seen in the drawing, having a body 21.

Boom and bucket valves 11 and 13 are located in a common valve body 18 in a series type flow path.

Control valves 11 and 13 are supplied pump pressure from pump 22 through inlet cavity 24. Connected with cavity 24 is a conventional system relief valve 26 which relieves pressure in inlet cavity 24 into reservoir cavity 30. Boom valve spool 28 is positioned in a bore 29 which passes through valve body 18. From left to right, bore 29 first intersects reservoir cavity 30, return cavity 32, motor port cavity 34, power passage 36, pump inlet cavity 24, open-center passage 38, power passage 40, motor port cavity 42, return cavity 32 and reservoir cavity 30. Power passages 36 and 40 are always open to pump inlet cavity 24 via passages 98 (symbolically shown). Attached to the right end of spool 28 is a conventional centering spring mechanism 44 which returns the valve spool to its neutral position, as indicated by the drawing. Valve spool 28 includes the following lands 31, 33, 35 and 37.

Bucket valve spool 46 is positioned in a bore 47 which also passes through valve body 18. Bucket spool bore 47, from left to right, first intersects reservoir cavity 30, motor port cavity 48, power passage 50, open-center cavity 54, downstream open-center cavity 56, power passage 58, motor port cavity 60 and reservoir cavity 30. Power passages 50 and 58 are always open to open-center cavity 54 via passages 99 (symbolically shown). U-shaped reservoir cavity 30 drains to reservoir 49 at all times, regardless of positions of valve spools 28 or 46. Attached to the right end of valve spool 46 is a common centering spring 64 covered by a conventional vented cap 66. Valve spool 46 includes the following lands, 39, 41, 43 and 45.

Flow divider valve body 21 includes an inlet cavity 62 which supplies a flow-dividing shuttle spool 65 through a lateral opening 66 in the center of the spool and a second flow path across orifice 68. Located in the left end of the spool 65 is a fixed orifice 67 which is sized to create whatever flow proportion is desired between orifice 67 and orifice 68. Shuttle spool 65 is slidably positioned in a bore which intersects boom motor port cavity 69 on its left end and bucket motor port cavity 70 on its right end. Located in the right and left ends of spool 65, respectively, are orifices 71 and 72 which function as variable orifices depending on their relative position to adjacent cavities 69 and 70. The opposite ends of shuttle spool 65 are subject to the pressure upstream of the variable orifices 71 and 72 and those opposite ends act as servo chambers which apply opposing forces to the shuttle spool to position the spool 65 where the forces are always balanced. The pressure acting on the right end of spool 65 is that pressure immediately downstream of orifice 68 in passage 63. The pressure acting on the left end of spool 65 is that pressure just downstream of fixed orifice 67, in the center of the spool 65. Spool 65 will adjust itself so that the variable orifices 71 and 72 maintain a balanced force acting on the spool. A balanced force on the spool means the pressure drop across orifice 68 is the same as across orifice 67, which in turn means the flow rates to each are maintained in a constant proportion. Connecting boom motor port cavity 69 with inlet cavity 62, so as to bypass shuttle spool 65, is a lateral passage 61 which contains a check valve 59.

A more detailed description of the function of shuttle spool 65 is given in U.S. Pat. No. 4,408,518 mentioned above.

Flow divider valve 20 takes the flow entering inlet cavity 62 and splits it into two flow paths with the first passing across orifice 68 and bucket motor port cavity 70 via check valve 51 to the cap end of bucket cylinder 14 in line 80. The second flow path flows back to motor port cavity 42, of the boom control valve 11, via fixed orifice 67, variable orifice 71, boom motor port cavity 69 and line 82.

Located in the flow divider valve 20 is another spool type valve 86 which functions as an unloading valve and a relief valve. Spool 86 is urged to the right by spring 87 while the right end of spool 86 is exposed to the pressure in bucket motor port cavity 70. To prevent a cavitation situation, as discussed in detail in above-mentioned U.S. Pat. No. 4,408,518, valve spool 86 blocks the return flow from the rod end of bucket cylinder 14 via bucket motor port cavity 52 and cavity 69, when there is insufficient pressure in bucket motor port cavity 70, which senses the pressure on the opposite side of bucket cylinder 14. With sufficient pressure in bucket cavity 70 acting against spring 87, the spool 86 will shift leftwardly opening grooves 89, thereby allowing the rod end of the bucket cylinder to drain back into reservoir via motor port 42, passages 38, 56 and 30. To open the return flow from the rod end of the bucket cylinder 14, just mentioned, spool 86 must move a distance A, as shown in the drawing, to open grooves 89. When the pressure in bucket cavity 70 reaches a high pressure relieving level, lateral opening 88 in spool 86 opens into boom cavity 69, dumping to reservoir via motor port 42. The pressure relieving position of valve spool 86 requires movement of the spool a further distance B, as illustrated in the drawing. The size and rate of spring 87 can be designed accordingly, so that spool 86 opens grooves 89 at a relatively low pressure, and lateral opening 88 at a relatively high pressure.

The self-leveling system 10 in the present invention would typically be used on a front end loader with a series type open-center constant flow system, as distinguished from the more complex load responsive or other types of variable flow systems.

The boom and bucket control valves 11 and 13 are conventional valves normally used in basic open-center systems which do not self-level. In such a system, the boom and bucket valves 11 and 13 would be connected only to their respective cylinders 12 and 14.

OPERATION

With boom and bucket spools 28 and 46 in their neutral positions, as indicated in the drawing, there is no pressure build-up in the inlet cavity 24 since the pump flow freely passes through open-center passages 38, 54, 56 back to reservoir 49.

If it is the intent of the operator to raise the boom 15 while maintaining the bucket 16 in a level position, boom valve spool 28 is moved to the right to the raised position. In the raised position, spool land 33 blocks flow to the open-center passage 38 causing pressure to build in inlet cavity 24, while the left edge of land 33 opens power passage 36 to motor port 34 (via passage 98) allowing pump pressure to enter the cap end of boom cylinder 12. As the boom begins to raise, the discharge flow from the rod end of cylinder 12 enters inlet cavity 62 of flow divider valve 20. From cavity 62, the flow is split with a portion flowing across orifice 68 and passage 63 and the other portion flowing across orifice 67 in spool 65. The flow across orifice 68 is directed to the cap end of bucket cylinder 14 while the flow across orifice 67 is directed back to reservoir 49. As flow begins across orifices 68 and 67, the flow divider spool 65 will shift accordingly, since the pressure downstream of both orifices 68 and 67 will be experienced on opposite ends of spool 65. If there is too much flow across orifice 68 to the cap end of cylinder 14, the lesser pressure drop across orifice 67 will cause a force imblance on spool 65, causing the spool to shift in a rightward direction. A rightward shift of the spool will cause variable orifice 72 to close down while variable orifice 71 in the opposite flow path is further opened. These variable orifices 72 and 71 will restrict the excessive flow across orifice 68 to be restricted so that the flow to both flow paths remains proportionately divided at the same rate. Regardless of the amount of flow into the divider valve 20, or the pressure levels it reaches, the shuttle spool 65 will proportionately divide or split the flows into cavities 69 and 70, respectively, with the proportion being preset by the comparative orifice sizes of orifices 67 and 68. In other words, if it is desirous to obtain one-third of the flow to bucket cylinder 14 and twothirds of the flow to boom motor port 42, the orifices 68 and 67 will be accordingly sized. Since orifice 68 is externally adjustable by set screw, it is possible to adjust the proportion so that the hydraulic system can accurately be fitted to the particular loader so as to very accurately provide the necessary flow to the bucket cylinder to maintain a level condition. To achieve this adjustment function in the prior art valves of U.S. Pat. No. 4,408,518, it was necessary to replace the flow divider valve spool 65 with different orifice sizes in the particular spool. The present flow divider valve 20 can now achieve this same function by a mere screw adjustment of orifice 68.

As the boom 15 continues to rise, the flow is split at divider valve 20 with a portion of the flow passing to the cap end of bucket cylinder 14 via orifice 72, cavity 70, check valve 51 and bucket motor port cavity 70. The other split flow in cavity 62 flows back through the boom motor port 42. The left edge of land 37 on the boom spool opens port 62 to return cavity 32, which in turn is open to reservoir 49 as long as bucket spool 46 has its open-center cavities 54 and 56 open.

The flow exhausting from the rod end of bucket cylinder 14 enters flow divider valve 20 through cavity 52 and passes to reservoir 49 across unloading valve spool 86 as long as there is sufficient pressure in cavity 70. If bucket cylinder 14 attempts to overspeed and cavitate due to weight in the bucket, the pressure in the cap end of cylinder 14 drops to zero which is felt in cavity 70, allowing unloading spool 92 to shift to the right due to the spring 87 and block flow from the rod end of bucket cylinder 14 to drain. The rod end of cylinder 14 is thereby blocked until pressure again builds in the cap end of cylinder 14, thereby preventing cavitation. If the bucket cylinder 14 is already fully extended when the boom valve 11 is moved to the raise position, it is necessary to have a relief valve at the cap end of the bucket cylinder (which is cavity 70) since there will be no place for the divided flow coming across orifice 68 to flow into bucket cylinder 14 (since the bucket cylinder is at the end of its stroke). In prior art systems, such as the patent mentioned above, this relief function was accommodated by a separate high pressure relief valve positioned in cavity 70. In the present invention, unloading valve spool 86 performs the relieving function. As the pressure builds in cavity 70 to relief levels, spool 86 moves further to the left, due to the pressure experienced on the right hand of the spool until lateral passage 88 is opened into motor port cavity 69, which in turn is connected to drain. This relieving function will allow the boom 15 to lift while the bucket circuit remains in a static condition and the self-leveling function is basically overridden.

If during the raising of the boom 15, the operator decides to override the self-level function and dump the bucket as the boom is rising; the operator would move the bucket spool 46 to the left from its neutral position, as shown in the drawing. Land 43 on the bucket spool would block the open-center flow through cavities 54 and 56 thereby building pressure in cavity 54 upstream of the bucket spool 46 since there is return flow entering motor port 42 from the flow divider valve 20. This split flow from cavity 69, which normally is passed to drain across the open-center cavity 54 of the bucket, is now blocked at the open-center cavity 54 and is being forced into power passage 58 (via passage 99). With spool 46 shifted to the left, the right edge of land 43 opens power passage 58 to motor port 60, which in turn connects with the cap end of bucket cylinder 14. The rod end of bucket cylinder 14 is open to drain either through unloading valve spool 86 or across a parallel line 85 which connects with motor port 48 to drain due to the position of spool land 39. Since the split flow from flow divider 20 is supplied to the return side, through motor port 42 of the boom cylinder, there is fluid pressure available upstream of bucket spool 46 (via the edge of land 37 and passage 32) to effect an overriding function when the boom cylinder is in a raise position. In conventional series type circuits, this would not be possible since the actuation of any upstream valve would block the downstream valve from any pump pressure so long as the upstream valve was in an operative position.

When boom spool 28 is shifted leftwardly to a lower position, left motor port 34 is open to drain while right motor port 42 is open to power passage 40. In this configuration, the flow through the divider valve 20 is reversed with pump pressure entering boom motor port cavity 69 and exiting across check valve 59 through cavity 62 into the rod end of boom cylinder 12. In the prior art, U.S. Pat. No. 4,408,518, the pump pressure flow to the rod end of the boom cylinder was very restricted since it had to flow backwards across the fixed orifice in the flow divider spool equivalent to orifice 67. This severely limited the lowering speed of the boom and created a potential cavitation situation under heavy boom loads. The present invention bypasses the pump pressure flow around the shuttle spool 65 with lateral passage 61 and check valve 59 by connecting passage 69 with inlet passage 62. The flow rate across check valve 59 is basically unrestricted, allowing the boom to lower at a much increased rate. This bypassing of the flow across lateral passage 61 also eliminated the need for a spring on the left hand end of shuttle spool 65.

Having described the invention with sufficient clarity to enable those familiar with the art to construct and use it, I claim:

1. A self-leveling hydraulic system controlling two or more functions including a boom and bucket; double-acting cylinders controlled by separate boom and bucket directional control valves and an open-center series circuit with the boom control valve located upstream of the bucket control valve with a pressure source supplying the valves in a series path across open-center positions of each valve to reservoir;

a self-leveling valve including a flow-dividing valve means connected to the rod end of the boom cylinder which splits the flow from the boom cylinder into two flow paths;

a first passage means connecting the first of said two flow paths with an end of the bucket cylinder supplying a sufficient flow to maintain the bucket at a level position as the boom raises;

a second passage means connecting the second of said two flow paths with an open-center path downstream of the boom valve and upstream of the bucket valve whereby the bucket valve can be separately actuated concurrent with the boom valve and supplied with oil so as to override the boom cylinder if desired;

a third passage means connecting the opposite end of the bucket cylinder with the second passage means whereby the bucket cylinder discharge is returned to the circuit upstream of the bucket control valve, and the improvement comprising:

a servo-operated spool type valve means with dual functions as an unloading valve and a relief valve positioned in said third passage means normally spring-biased closed in a first position blocking flow in the third passage means and a servo means acting on the valve against said biasing means sensing pressure in the first passage means which in a second spool position opens flow in the third passage means when a minimum pressure level is reached in the first passage means and a third spool position when maximum pressure is reached in the first passage means which opens the first passage means to relief into the second passage means.

* * * * *